United States Patent [19]

Littwin et al.

[11] Patent Number: 4,672,345

[45] Date of Patent: Jun. 9, 1987

[54] DEGAUSSER/DEMAGNETIZER

[75] Inventors: Kenneth M. Littwin, Chicago; Joseph A. Armond, River Grove; Fred Patrick, Chicago, all of Ill.

[73] Assignee: Electro-Matic Products Co., Chicago, Ill.

[21] Appl. No.: 779,630

[22] Filed: Sep. 24, 1985

[51] Int. Cl.[4] ..... H01F 13/00

[52] U.S. Cl. ..... 335/284; 361/151

[58] Field of Search ..... 335/284; 361/143, 149, 361/151

[56] References Cited

U.S. PATENT DOCUMENTS

| | | | |
|---|---|---|---|
| 3,023,280 | 2/1962 | Tronslin et al. | 361/151 |
| 3,506,884 | 4/1970 | McKinley | 361/151 |
| 3,711,750 | 1/1973 | Huffman et al. | 361/151 |
| 3,938,011 | 2/1976 | Littwin | 361/151 |
| 4,423,460 | 12/1983 | Jackson et al. | 361/149 X |
| 4,470,094 | 9/1984 | Armond et al. | 361/149 |

*Primary Examiner*—Patrick R. Salce
*Assistant Examiner*—Anita M. Ault
*Attorney, Agent, or Firm*—Paul H. Gallagher

[57] ABSTRACT

An upper magnet and a lower magnet respectively above and below the objects to be degaussed/demagnetized. They are arranged with their fields mutually transverse, and both at 45° angles to a conveyor carrying the objects between the magnets. Either or both magnets may be rotated, selectively, and they are rotated in opposite directions.

3 Claims, 7 Drawing Figures

DEGAUSSER/DEMAGNETIZER

FIELD OF THE INVENTION

The invention resides in the broad field of demagnetizing, in industry, which includes the specific field of degaussing. In the specific field of degaussing, the principal example of object to be degaussed is magnetic tapes, while the broad field of demagnetizing includes the demagnetizing of other and various objects as well. A principal example of the use of such demagnetizing in other than the specific field of degaussing is in connection with grinders; in grinding a metal (magnetic) workpiece, it is held down on the grinder by an electro-magnet, and after the grinding operation is completed, the electro-magnet is turned off, but the residual magnetism in the workpiece is substantial, and many times it is very great, and the demagnetizer is utilized for removing that residual magnetism from the workpiece.

CROSS REFERENCE

Patent application Ser. No. 753,597, filed July 10, 1985 by the present Littwin, Armond and Patrick, and Gabriel R. Buky.

OBJECTS OF THE INVENTION

A broad object of the invention is to provide a degausser/demagnetizer having the following features and advantages:

1. It is unusually effective for producing a degaussing/demagnetizing effect.
2. More specifically, it includes magnets over and under the object to be treated, which interact and combine to produce the intended result.

DESCRIPTION OF A PREFERRED EMBODIMENT

While the invention relates to degaussing, it is also included in the broad field of demagnetizing. The term degaussing is most often used, instead of demagnetizing, in connection with magnetic tapes. These tapes are used for recording magnetic signals in the electronics field, including radio, TV, etc. The tapes are of great length, and are rolled in spirals and in degaussing them, instead of running the tapes through the degaussing field linearly, the complete spiral tapes are put through the degaussing field and degaussed in bulk. Many problems have occurred in the degaussing field, in eliminating or erasing the last vestiges of the signals in the tape. Due to the spiral shape of the tape, the directions of the original magnetizing are infinite, because of the continuous curved shape of linear elements of the tape. Heretofore it has been extremely difficult to eliminate such last vestiges of signals, and very often portions of the signals, or noise, remained at certain predetermined positions, such, for example at locations relatively 180° apart from each other.

Reference is now made to the detail mechanical construction of an apparatus embodying the principles of the invention as referred to above. For simplicity and convenience, the apparatus will be referred to most often herein as a degausser, although it may be referred to as a demagnetizer, as well.

Figure 1:
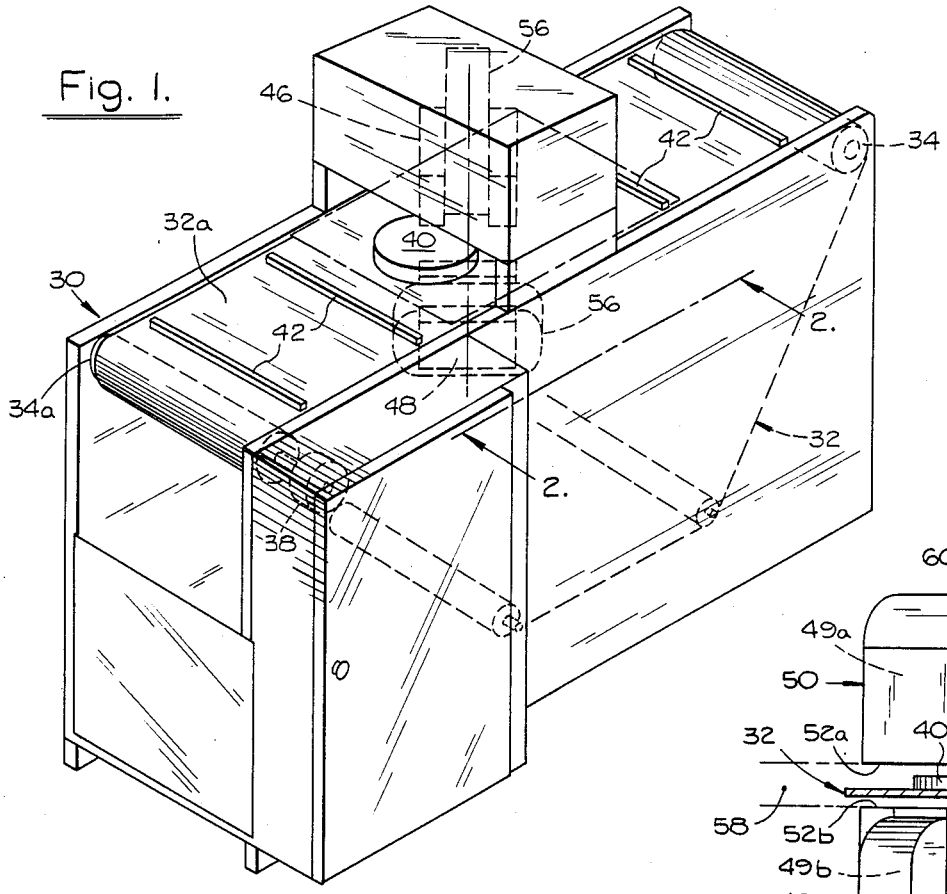
FIG. 1 is a perspective view, including certain major components involved in an apparatus embodying the invention.

FIG. 1 shows a stand 30 of suitable kind into which is built a conveyor 32 trained over pulleys 34, one of which, e.g., **34*a* is a driving pulley driven by a suitable motor 38**, for driving the conveyor.

Tapes are indicated at 40, resting on the upper run **32*a* of the conveyor, and carried thereby. The conveyor may be of conventional type, having cleats 42** thereon ordinarily utilized for carrying the articles therealong.

Figure 4:
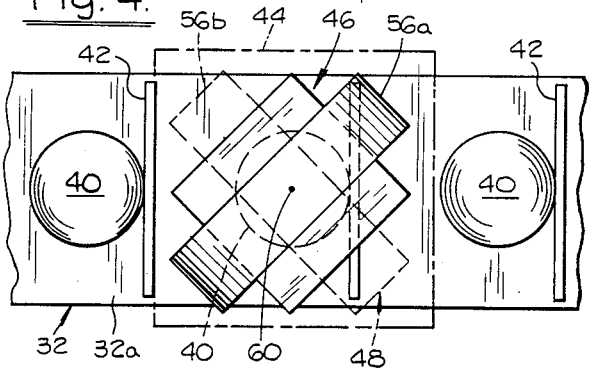
FIG. 4 is a top view taken at line 4—4 of FIG. 2.

The articles to be degaussed, or tapes, are put through the degaussing operation while carried along the conveyor. A degaussing field is established by a pair of electro-magnets arranged according to the main concept of the invention, namely above and below the articles, as referred to above. The degaussing field referred to, is indicated at 44, in FIG. 4, this being a diagrammatic indication of the field. As will be referred to again hereinbelow, that field is quite indefinite, but its intense portion is in immediate association with the tapes.

For convenience, the electro-magnets may be referred to simply as magnets. A pair of such magnets are provided, i.e., an upper magnet 46 and a lower magnet 48, in direct vertical alignment on a vertical axis 60, respectively above and below the conveyor, and thus also above and below the articles, or tapes, thereon, to be degaussed. The magnets may be mounted in any suitable manner, and the specific details of structure for mounting them, are omitted from this description.

The magnets are of AC character, and the demagnetizing step takes place by moving the articles into the magnetic field, and withdrawing them therefrom, by carrying them on the conveyor. The field saturates the articles, oppositely in each half-cycle, and as they are withdrawn from the field, which is done gradually, the degree of saturation gradually diminishes until it reaches zero, resulting in the desired demagnetization.

Each magnet, the upper magnet 46 and the lower magnet 48, includes a core 49 having poles 50, the poles having end surfaces 52 lying in a common plane 54. These magnets are known as surface magnets, in which the coil 56 surrounds the midportion of the core, and the poles are displaced therefrom and lying in the plane mentioned, beyond the side surface of the coil.

Figure 3:
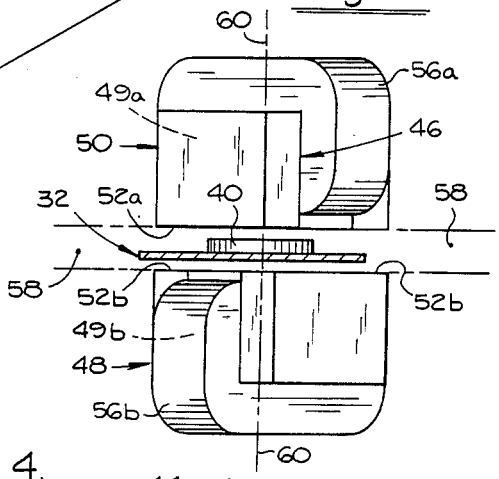
FIG. 3 is a view oriented according to line 3—3 of FIG. 2.
Figure 2:
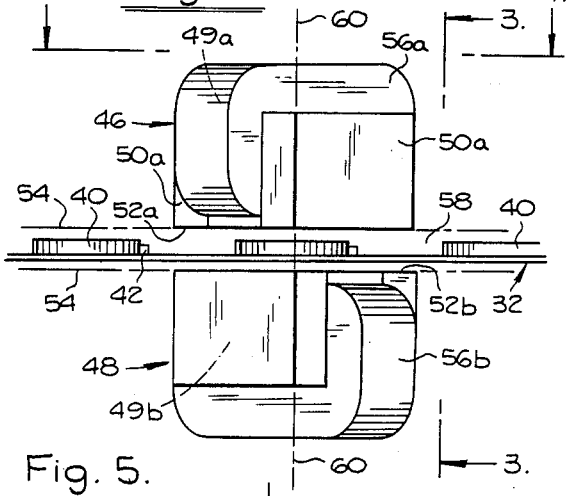
FIG. 2 is a view of a portion of the apparatus of FIG. 1 oriented according to line 2—2 of the latter figure.

The magnets 46, 48 are arranged in mutually opposed relation, with the pole surfaces 52 of the respective magnets directed toward each other. The upper run **32*a* of the conveyor carries the articles through the space 58 between the planes 54 (FIGS. 2 and 3**). This spacing is preferably only sufficient to accommodate the conveyor run and the articles and because of this close spacing, the magnetic fields from the magnets have maximum effect in the degaussing function, i.e., the articles are close to the most intense portion of the field, or that adjacent the pole surfaces.

The magnets are arranged relative to each other, and relative to the direction of travel of the conveyor, so as to provide the greatest degaussing effect. The two magnets are arranged at 90° relative to each other, and both positioned at 45° relative to the direction of travel of the conveyor. The angular position of each magnet produces an effect on the tapes that could not be effected in either position longitudinally or or transversely across the conveyor. Additionally, the magnetic fields of the two magnets, due to their relative angular arrangement of 90°, extend through each other, each producing an intensifying effect on the other, and both thereby producing a greater demagnetizing effect.

In the degaussing operation, the tapes 40 are placed on the conveyor run by any suitable means, such as another conveyor means in an assembly line, for example. The mechanical portion of that phase of the operation, need not be entered into, and the matter here involved is merely the passage of the tapes between the magnets in the degaussing station, and the consequent degaussing step. In degaussers and demagnetizers of kinds heretofore known, great difficulty has been encountered in complete degaussing because of the difficulty of orienting the magnets in relation to the articles to be degaussed, i.e., the tapes. Because of the spiral winding of the tapes, the linear elements of each tape assume an infinite number of positions and directions. Consequently a static magnetic field reaches only in one direction and is effective for the intended degaussing step only to a limited extent. For example, any of the elements of the tapes that the lines of force of the magnetic field penetrate perpendicularly, are effectively demagnetized, but in most others the demagnetizing step is less than perfect, and the deficiencies in that degaussing step increased progressively toward the position in which the magnetic field lies linearly in or parallel with the linear elements of the tape. Various instrumentalities and techniques have been resorted to to overcome these difficulties, but none of them have been fully satisfactory.

The opposed arrangement of the magnets 46, 48 in mutually transverse directions, produce a highly efficient degaussing and demagnetizing result. While the complete answer to this phenomenon is not known, it is believed that at least a portion of the good effect results from the interaction between the fields of the magnets. It is believed that there is a "bouncing" effect between the magnetic fields or between the individual lines thereof. In other words, the lines of force of one field may actually penetrate through the elements of the tapes, or be reflected or "bounced" from an element of the other field, and returned, and in the return path penetrate through the tape in different directions.

Figure 5:
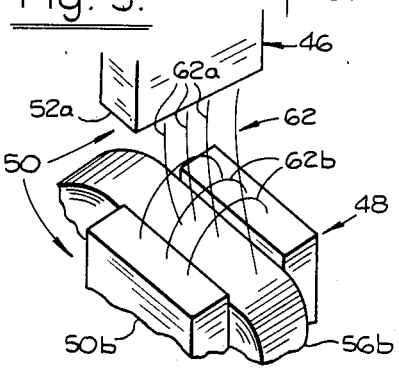
FIG. 5 is a fragmentary perspective view showing portions of the upper and lower magnets incorporated in the apparatus.

FIG. 5 shows fragments of the poles 50, and in the case of the poles 50*a*, only the far one. This figure shows the magnetic fields of the two magnets, indicated at 62, where the lines 62*b* are shown extending across the corresponding pole surfaces in one direction, and the lines 62*a* of the other field extend transverse to those of the first field, and in this case substantially perpendicular thereto. These lines of force of the two fields therefore penetrate through every element of the article to be demagnetized, and specifically every element of the wound tape. As the tape moves along the conveyor, the relationship of the lines of force to the tape constantly change, and notwithstanding the infinite number of directions of the elements of the tape, each element is effectively reached by the lines in at least one of the fields.

Figure 6:
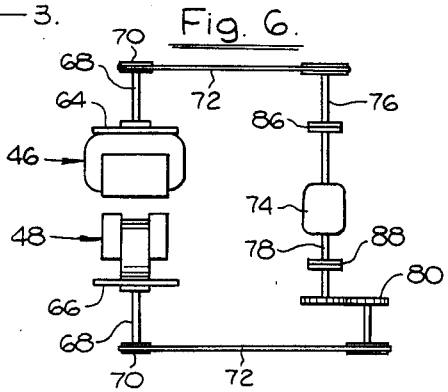
FIG. 6 is a semi-diagrammatic view showing an arrangement for rotating the electro-magnets.
Figure 7:
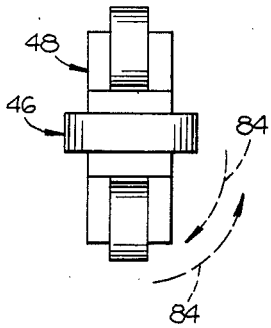
FIG. 7 is a semi-diagrammatic view from the top of the left hand portion of FIG. 6.

While the main concept of the invention includes the arrangement of the magnets over and under the articles to be demagnetized, it is within the scope of the invention to incorporate the additional feature of rotating either or both of the magnets. The broad concept of rotating a magnet is included in the co-pending application identified above, but that feature may also be incorporated in the broad concept of having over and under magnets, as in the present invention. This feature of rotatability of the magnets is represented in FIGS. 6 and 7, which illustrate that feature semi-diagrammatically. Referring first to FIG. 6, the magnets 46, 48 are mounted by suitable means for rotation. This mounting means may include simple plates 64, 66 having shafts 68 with pulleys 70 driven through belts 72 by a motor 74. The magnets are arranged for rotation in mutually opposite directions, the motor 74 having drive shafts 76, 78, and gearing 80 in one of those shafts for reversing the drive therethrough. FIG. 7 represents the corresponding direction of rotation of the magnets as indicated by the arrows 82, 84. While it would be desirable to rotate both of the magnets in any degaussing step, it may be desired, in special occasions, to rotate either one of them alone, without rotating the other, and for this purpose, clutches 86, 88 are interposed in the drive shafts 76, 78, respectively.

I claim:

1. Degaussing apparatus comprising, a frame, a conveyor mounted in the frame and having a run moving through the frame past a degaussing station, and capable of supporting articles to be degaussed and carrying them past the degaussing station, and a magnet above and a magnet below said run of the conveyor enabling the articles to pass between the magnets, the magnets being on a common vertical axis, internal to the magnets and passing through said degaussing station, each magnet having transversely spaced poles facing the other magnet, and the magnets being disposed with their fields disposed at 90° relative to each other, and each at 45° relative to the direction of travel of the run of the conveyor.

2. Degaussing apparatus according to claim 1 wherein, the magnets are in a fixed location, with their said common axis in such location that it passes through the articles substantially at all times the articles are passing thereby.

3. Degaussing apparatus according to claim 2 wherein, the magnets extend substantially across the conveyor run, whereby all portions of the articles are contained entirely within the transverse limits of the fields of the magnets, and pass entirely therethrough in longitudinal direction.

* * * * *